United States Patent [19]

Davies

[11] 3,963,450

[45] June 15, 1976

[54] REINFORCED CAST PRODUCT AND METHOD OF MAKING

[75] Inventor: Barry J. Davies, Burlington, Canada

[73] Assignee: Canron Limited, Montreal, Canada

[22] Filed: July 24, 1974

[21] Appl. No.: 491,460

[52] U.S. Cl. ..... 29/191.4; 164/100; 164/111

[51] Int. Cl.[2] ..... B22D 19/02

[58] Field of Search ..... 164/411, 78, 86, 108 US, 164/102, 104, 98, 75, 109, 72, 332, 333, 334, 100; 249/144, 146, 147, 91; 29/191.4, 196.1, 111, 187.5, 191, 527.3

[56] References Cited

UNITED STATES PATENTS

| | | | |
|---|---|---|---|
| 388,696 | 8/1888 | Lavigne | 164/108 |
| 2,890,318 | 6/1959 | Kruse | 164/98 X |
| 3,428,464 | 2/1969 | Pollard | 106/38.23 |
| 3,468,813 | 9/1969 | Mindick et al. | 252/313 |
| 3,819,145 | 6/1974 | Huber et al. | 164/334 X |
| 3,822,736 | 7/1974 | Andoniev et al. | 164/100 |
| R26,969 | 10/1970 | O'Shea | 164/72 |

FOREIGN PATENTS OR APPLICATIONS

| | | | |
|---|---|---|---|
| 698,567 | 11/1964 | Canada | 164/108 |
| 1,051,598 | 9/1953 | France | 164/108 |
| 1,191,202 | 5/1970 | United Kingdom | 164/332 |
| 1,240,944 | 7/1971 | United Kingdom | 164/75 |

OTHER PUBLICATIONS

McGannon, *The Making, Shaping and Treating of Steel*, U.S. Steel Corp., 1964, p. 1125.

*Primary Examiner*—Ronald J. Shore
*Assistant Examiner*—Gus T. Hampilos
*Attorney, Agent, or Firm*—Fetherstonhaugh & Co.

[57] ABSTRACT

A reinforced ferrous metal casting and a method of making a reinforced ferrous metal casting wherein the reinforcing rods are located within tubular metal sheaths such that the metal sheaths become fused and bonded to the casting while the reinforcing rods located within the metal sheaths are not fused with respect to the sheaths and are, therefore, slidable within the casting. The reinforcing rods are preferably spaced from the sheath by a refractory coating.

7 Claims, 3 Drawing Figures

REINFORCED CAST PRODUCT AND METHOD OF MAKING

FIELD OF THE INVENTION

This invention relates to the production of ferrous castings with cast-in ferrous metal inserts. In particular, this invention relates to an improved method of preventing carburization and fusion of a cast-in reinforcing ferrous metal insert and the casting produced by this method.

PRIOR ART

In my prior United States application Ser. No. 412,177 filed Nov. 2, 1973, now U.S. Pat. No. 3,888,297 I have described a method of forming a cast-in metal insert wherein carburization and fusion of the cast-in insert with respect to the casting is prevented by the application of a refractory coating. While the coating described in my prior application works satisfactorily in castings of light to moderate thicknesses, I have found that in the heavier castings having section thicknesses of the order of 12 inches and a total weight of 7 tons the refractory coating does not completely eliminate caraburization of the steel reinforcing rods.

SUMMARY OF THE INVENTION

The present invention provides a method of manufacturing reinforced ferrous metal castings wherein carburization of the reinforcing rod is prevented by the use of a tubular metal sheath within which the reinforcing rods are located during the casting operation. While the sheath may be carburized any may fuse to the body of the casting, the casting operation does not cause carburization or fusion of the reinforcing rod with respect to the sheath.

According to a further embodiment of this invention, the reinforcing rod is coated with a coating which forms a hard non-yieldable refractory coating on the surface of the rod so that the refractory coating is disposed between the outer surface of the rod and the inner surface of the metal sheath during the casting operation, the coating serving to prevent carburization and fusion during the moulding of relatively large castings.

According to a preferred embodiment of the present invention, a method of manufacturing a reinforced ferrous metal casting comprises the steps of locating a reinforcing rod within the bore of a tubular metal sheath to form a composite reinforcing member, locating the composite reinforcing member in a mould in a manner such that it cannot be displaced during casting, and casting a ferrous metal about a compoite reinforcing member, said tubular sheath preventing carburization and fusion of the reinforcing rod with respect to the casting.

According to a further embodiment of the present invention, there is provided a reinforced casting comprising a body of cast ferrous metal having embedded therein at least one composite reinforcing member consisting of a tubular metal sheath having a reinforcing metal rod disposed therein, said rod being free from fusion with respect to said tubular metal sheath.

PREFERRED EMBODIMENT

The invention will be more clearly understood after reference to the following detailed specification read in conjunction with the drawings, wherein.

Figure 3:
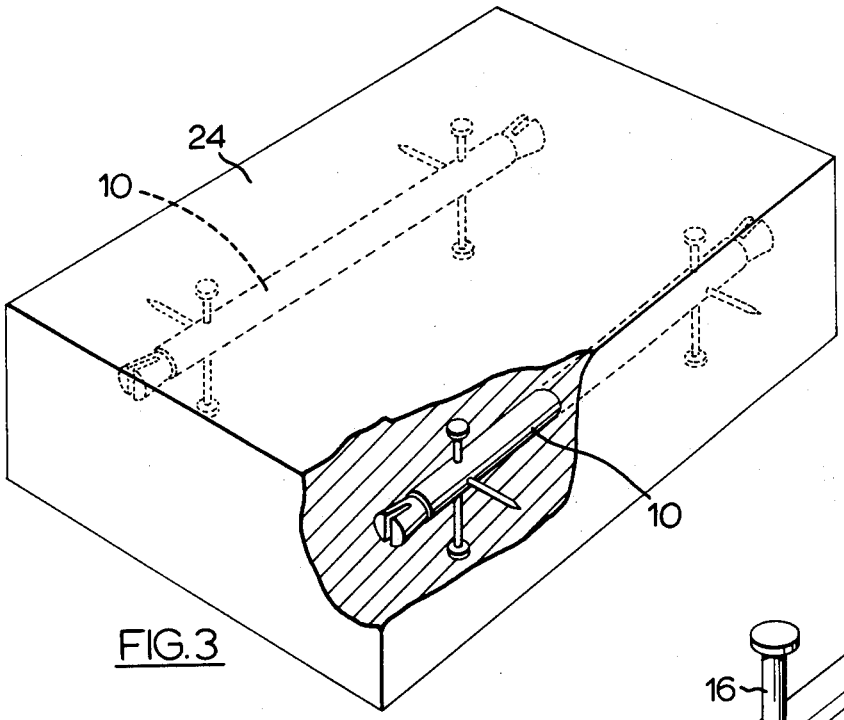
FIG. 3 is a partially sectioned pictorial view of a reinforced casting according to an embodiment of the present invention.
Figure 1:
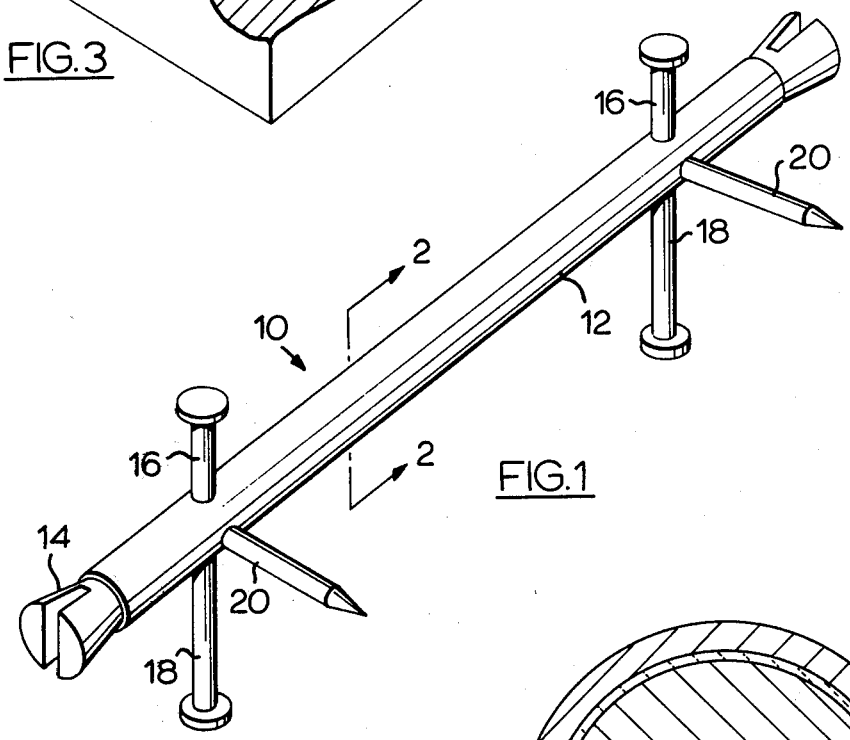
FIG. 1 is a pictorial view of a composite reinforcing member according to an embodiment of the present invention.

With reference to the drawings the reference numeral 10 refers generally to a composite reinforcing member which consists of a tubular metal sheath 12, reinforcing rod 14, support legs 16, 18 and 20, and a hard non-yieldable refractory coating 22. The tubular metal sheath 12 is preferably made from a relatively inexpensive metal as it will subsequently be carburized and fused to the casting. It has been found that black iron water pipe may be used for this purpose.

Figure 2:
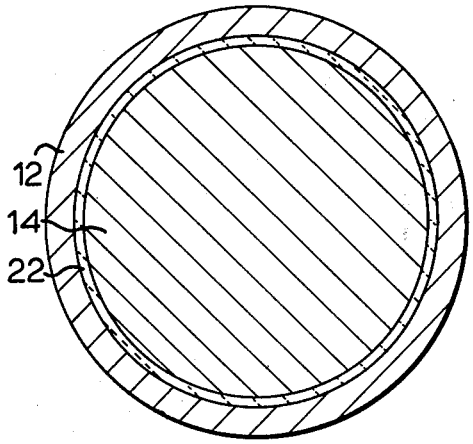
FIG. 2 is a sectional view taken along the line 2—2 of FIG. 1.

As shown in FIG. 2 of the drawings, the reinforcing rod 14 is spaced from the tube 22 by the thickness of the refractory coating 22. The rod 14 with the coating 22 applied fits in a close-fitting sliding relationship within the sheath 12.

FIG. 3 of the drawings serves to illustrate the manner in which a pair of composite reinforcing elements 10 may be located in a casting 24 at locations spaced inwardly from the outer faces of the casting.

The reinforcing rod 14 is preferably made from mild steel. The outer surface of the reinforcing rod 14 is cleaned and prepared to receive the refractory coating in a conventional manner as by degreasing, etching, sand-blasting or the like. Preferably the rod 14 is preheated prior to the application of the refractory coating to a temperature of about 150°F. The purpose of the preheating step is to speed the drying of the refractory coating. The coating is then applied by brushing, spraying, or dipping. Drying of the coating may be assisted by blowing warm air or by the application of heat lamps or the like. If a post-drying operation is carried out, the preheating steps previously described may be eliminated.

It has been found that a suitable refractory coating for application to a ferrous metal insert such as a steel or nodular cast-iron rod which is to be located within the sheath 12 consists of a microscopic finely divided refractory of solid particles suspended in an aqueous liquid containing a binder. A suitable composition may be a vitreous silica dispersion. Alternative compositions may include non-silicose refractories such as alumina and graphite. The binder is preferably in the form of a colloidal silical sol. The proportions of the refractory solid particles and the aqueous liquid containing the binder are preferably within the range of 10 to 70% by weight and 30 to 90 % by weight respectively. The suspension is stabilized by intimate dispersion therewith and the stabilizing amount of xanthomanas hydrophylic colloid. A coating of this type has been found to have satisfactory resistance to carburization and is presently used to prevent fusion of cast ingots to an ingot stool. The problems associated with carburization are critical to the present invention but are not of any concern in the use of the coating in association with an ingot casting stool.

A coating suitable for use in the present invention is known by the registered trade mark "NALCOTE 4120" and is manufactured by Alchem Limited of Burlington, Ontario, Canada. It has been found that a coating thickness of the order of about 0.015 inches provides adequate protection for most reinforcing rods. However, the thickness can be increased by the application of additional coatings to a thickness of the order of about 0.015 inches or more as required.

After the reinforcing rod has been coated with the refractory material and the refractory material has hardened, the rod 14 is located within the bore of the tube 12 and the ends of the rod are flared to lock the rod within the tube. The flared ends also serve to secure the reinforcing rod within the casting in use so that if the casting cracks it will be held together with the reinforcing rods. Alternative methods may be employed to lock the rod within the tube. According to one alternative, the combination rod and tube may be bent out of the straight configuration after assembly so that the bending of the composite reinforcing member will prevent removal of the reinforcing rod. In some instances the composite reinforcing member may have a horseshoe configuration or the like, depending upon the shape of the finished casting.

Because of the difference between the coefficient of expansion of the steel reinforcing rod and the body of the casting, the flared ends of the reinforcing rod will cause the reinforcing rod to apply a compressive force to the casting after cooling following the casting operation. The casting will, in fact, be prestressed by the reinforcing rod 14. Prestressing is of considerably advantage in cast-iron structures which are inherently more capable of resisting compressive loads than tensile loads.

It has been found that a cast-iron casting measuring 12 inches in thickness by 78 inches in length and 48 inches in width, weighing approximately 6 ½ tons, can be effectively reinforced by composite reinforcing members of the type described above wherein the sheath is a 2 inches black iron water pipe (Schedule 40) measuring 32 inches in length and the reinforcing rod is a 2 inch diameter rod measuring 36 inches in length; the coating applied to the reinforcing rod being a NALCOTE 4120 coating having a thickness of the order of about 0.005 inches; the ends of the reinforcing rod being flared outwardly to a sufficient extent to lock the reinforcing rod within the metal sheath; the sheath being provided with chapplets and locating pins as described above.

Various modifications of the present invention will be apparent to those skilled in the art without departing from the scope of the invention.

While in the preferred embodiment described above, a NALCOTE coating is applied to the surface of the reinforcing rod it has been found that it is possible to dispense with the NALCOTE coating in the areas of the reinforcing rod which are completely covered by the metal sheath provided the metal sheath is sufficiently thick that it does become fused or bonded to the reinforcing rods during casting. It continues to be necessary to coat the exposed ends or any other portions of the reinforcing rods with a refractory coating. It has, however, been found that with the lighter castings which cool more rapidly, the reinforcing rods do not become carburized or fused to the metal sheath.

As previously indicated the reinforcing rod serves to hold the casting together in the event of a break-up of the brittle cast metal. This is achieved by reason of the fact that cracks formed in the cast metal will not extend through the more ductile reinforcing rods, and by reason of the fact that the reinforced rods as secured within the casting by the flared ends therof or the shape into which they are formed or by any other suitable means.

These and other advantages of the present invention will be apparent to those skilled int the art.

What I claim as my invention is:

1. A reinforced casting comprising a body of cast ferrous metal having enclosed therein at least one composite reinforcing member comprising a tubular metal sheath completely surrounding the central portion of a reinforcing rod slidably mounted within said sheath, opposite ends of said reinforcing rod projecting outwardly from opposite ends of the tubular metal sheath and being secured against movement with respect to said casting.

2. A reinforced casting as claimed in claim 1 wherein the reinforcing rod is spaced from the sheath by a coating in the form of a hard, non-yieldable refractory material which prevents carburization and fusion during casting about the composite reinforcing member.

3. A method of manufacturing a reinforced ferrous metal casting comprising the steps of a. locating a steel reinforcing rod within the bore of a tubular ferrous metal sheath to form a composite reinforcing member in which opposite ends of the reinforcing rod are exposed at opposite ends of the sheath, said opposite ends of the reinforcing rod being adapted to be anchored with respect to the casting, said tubular metal sheath being of sufficient thickness to protect the portions of the reinforcing rod located therein against carburization and fusion with said ferrous metal during casting;

b. locating said composite reinforcing member in a mould in a manner such that it cannot be displaced during casting, and c. casting a ferrous metal casting about said composite reinforcing member to completely encase the composite reinforcement and anchor said opposite ends of the reinforcing rod where exposed to the casting whereby the ends of the reinforcing rod are secured with respect to the casting and the portion of the rod intermediate said ends is movable with respect to the tubular ferrous sheath and thereby serves to reinforce the casting.

4. A method as claimed in claim 3 including the step of coating the external surface of the intermediate portion of the reinforcing rod to form a hard, non-yieldable refractory coating thereon adapted to prevent carburization and fusion of the outer surface of the rod with respect to said tubular sheath during casting.

5. A method as claimed in claim 4 wherein the outer surface of the tubular member is fused to the casting during the casting step.

6. A method as claimed in claim 4 wherein the reinforcing rod is locked within the tubular member prior to casting to prevent removal therefrom.

7. A method of manufacturing a reinforced ferrous metal casting comprising the steps of a. locating a reinforcing rod within the bore of a tubular metal sheath to form a composite reinforcing member, b. locking said tubular member with respect to said casting by flaring end portions of the rod projecting outwardly from opposite ends of the tubular member, locating said composite reinforcing member in a mould in a manner such that it cannot be displaced during casting, and c. casting a ferrous metal casting about said composite reinforcing member to completely encase the composite reinforcement and embed the reinforcing rod within the casting.

* * * * *